US007950200B2

(12) United States Patent
Tropiano

(10) Patent No.: US 7,950,200 B2
(45) Date of Patent: May 31, 2011

(54) MULTI-PURPOSE ANCHORING APPARATUS AND METHOD

(76) Inventor: Robert Tropiano, Clifton, NJ (US)

( * ) Notice: Subject to any disclaimer, the term of this patent is extended or adjusted under 35 U.S.C. 154(b) by 602 days.

(21) Appl. No.: 11/903,383

(22) Filed: Sep. 20, 2007

(65) Prior Publication Data

US 2008/0083172 A1 Apr. 10, 2008

Related U.S. Application Data

(63) Continuation-in-part of application No. 10/842,224, filed on May 10, 2004, now abandoned.

(51) Int. Cl.
*E04H 15/28* (2006.01)

(52) U.S. Cl. ..... 52/745.21; 52/157; 52/165; 248/545; 135/98

(58) Field of Classification Search ..... 52/155, 52/157, 165, 745.21; 248/530, 545, 156; 135/96, 98; 405/252.1; 175/349, 391
See application file for complete search history.

(56) References Cited

U.S. PATENT DOCUMENTS

| | | | | | |
|---|---|---|---|---|---|
| 2,165,962 | A | | 7/1939 | Mueller-Cunradi et. al. | |
| 2,261,527 | A | * | 11/1941 | Shannon | 248/545 |
| 2,709,573 | A | * | 5/1955 | Reed | 175/388 |
| 2,838,285 | A | * | 6/1958 | Gredell | 175/391 |
| 3,043,383 | A | * | 7/1962 | Newbold | 175/383 |
| 3,285,203 | A | * | 11/1966 | Meyer | 108/50.12 |
| 3,949,962 | A | | 4/1976 | Wilson | |
| 4,148,455 | A | | 4/1979 | Oliver | |
| 4,592,284 | A | | 6/1986 | Fukuda | |
| 4,609,175 | A | | 9/1986 | Conover | |
| 4,624,275 | A | | 11/1986 | Baldwin | |
| 4,687,012 | A | | 8/1987 | Schultes et al. | |
| 4,789,200 | A | | 12/1988 | Munguia | |
| 4,800,909 | A | | 1/1989 | Seidel et al. | |
| 4,850,555 | A | * | 7/1989 | Lemkin et al. | 248/87 |
| 4,850,564 | A | * | 7/1989 | Padin | 248/533 |
| 4,920,897 | A | * | 5/1990 | Reed et al. | 108/150 |
| 4,923,165 | A | | 5/1990 | Cockman | |
| 4,939,877 | A | * | 7/1990 | Claffey | 52/155 |
| 4,972,978 | A | | 11/1990 | DeLuca | |
| 5,046,699 | A | * | 9/1991 | Perreault et al. | 248/533 |
| 5,069,237 | A | | 12/1991 | Flanagan | |
| 5,152,495 | A | * | 10/1992 | Jacinto et al. | 248/545 |

(Continued)

OTHER PUBLICATIONS

Information Disclosure Statement submitted in parent U.S. Appl. No. 10/842,224.

*Primary Examiner* — Brian E Glessner
*Assistant Examiner* — Adriana Figueroa
(74) *Attorney, Agent, or Firm* — Powley & Gibson, P.C.

(57) ABSTRACT

An apparatus is disclosed which includes a drilling device and a tube. The drilling device typically has a first end, at which a point is located and a second end which is connected to a first end of the tube. The apparatus also includes an insertion bar having a first end inserted into the tube and a second end at which a latching device is located. The latching device can set a location of the insertion bar with respect to the tube so that a height is set. The apparatus may also include a first pole receiver connected at the second end of the insertion bar. The apparatus may include a handle which can be inserted into the insertion bar for rotating the insertion bar, tube, and drilling device to drill the drilling device into the ground.

22 Claims, 12 Drawing Sheets

U.S. PATENT DOCUMENTS 5,156,369 A * 10/1992 Tizzoni ..... 248/545
5,199,361 A 4/1993 Robinson
5,293,889 A * 3/1994 Hall et al. ..... 135/16
5,358,209 A * 10/1994 Ward ..... 248/545
5,417,166 A * 5/1995 Credle, Sr. ..... 108/50.12
D366,372 S * 1/1996 Skarda, Jr. ..... D6/417
5,482,246 A 1/1996 Derkoski
5,645,094 A * 7/1997 Wu ..... 135/24
5,692,720 A * 12/1997 Griggs ..... 248/530
D394,544 S 5/1998 Tropiano
5,823,214 A 10/1998 Seidel
5,906,077 A * 5/1999 Andiarena ..... 52/157
D421,532 S * 3/2000 Koroncai ..... D6/417
6,113,339 A 9/2000 Adams
6,128,867 A 10/2000 MacKarvich
6,202,368 B1 3/2001 Wallace, III
6,298,611 B1 10/2001 Oliver et al.
6,305,882 B1 10/2001 Coast et al.
6,314,976 B1 11/2001 Clarke
6,334,281 B1 1/2002 Oliver et al.
6,401,739 B1 6/2002 Bright et al.
6,418,950 B1 7/2002 Tseng
6,487,977 B1 * 12/2002 Williams et al. ..... 108/50.12
6,497,296 B1 12/2002 McGriff et al.
6,547,203 B1 4/2003 Willard
6,668,471 B1 12/2003 Cook et al.
6,675,819 B2 * 1/2004 Arrowood et al. ..... 135/16
D507,817 S * 7/2005 Mitchell ..... D22/147
7,090,437 B2 * 8/2006 Pinkleton ..... 405/244
7,246,783 B2 7/2007 Harold
2001/0017150 A1 * 8/2001 Doreste ..... 135/15.1
2002/0175262 A1 * 11/2002 Brooks, III ..... 248/530
2002/0185167 A1 * 12/2002 Lin et al. ..... 135/16
2003/0079766 A1 * 5/2003 Arrowood et al. ..... 135/16
2004/0129184 A1 * 7/2004 Kraker ..... 108/50.12

* cited by examiner

MULTI-PURPOSE ANCHORING APPARATUS AND METHOD

CROSS-REFERENCE TO RELATED APPLICATIONS

This application is a continuation-in-part of earlier filed application Ser. No. 10/842,224, filed on May 10, 2004 now abandoned by the present inventor, the disclosure of which is hereby incorporated by reference in its entirety.

FIELD OF THE INVENTION

This invention relates to improved methods and apparatus concerning anchoring poles in the ground.

BACKGROUND OF THE INVENTION

The are many different known techniques for anchoring a pole in the ground.

SUMMARY OF THE INVENTION

The present invention, in at least one embodiment, provides an apparatus comprising a drilling device and a tube. The drilling device typically has a first end and a second end. A point is located at the first end of the drilling device. The tube typically has a first end and a second end. The first end of the tube is connected to the second end of the drilling device.

The apparatus also may include an insertion bar having a first end and a second end. The first end of the insertion bar may be inserted into the second end of the tube so that the insertion bar lies at least partially in the tube. The apparatus may also include a latching device which can set a location of the insertion bar with respect to the tube so that a height is set, wherein the height is measured from the second end of the insertion bar to the point at the first end of the drilling device.

The apparatus may also include an insertion bar with an insert having a cross-sectional shape of a cavity formed by a solid interior portion of a tube, so that the insertion bar may be slideably inserted within the tube.

The apparatus may also include a first pole receiver connected at the second end of the insertion bar. The first pole receiver can receive and retain a pole. The first pole receiver may include a latching mechanism for retaining a pole.

The insertion bar has a length and the insertion bar may have a plurality of holes dispersed along the length of the insertion bar. The latching device may include a portion which can be inserted into any one of the plurality of holes in order to set the location of the insertion bar with respect to the tube so that the height is set.

The drilling device may include a drill bar on which is located a first auger device and a second auger device. The second auger device may be closer to the point of the drilling device than the first auger device, and the second auger device may be smaller in diameter than the first auger device.

The drilling device may include a drill bar on which is located a modified auger device having supplemental cutting edges.

The apparatus may further include a handle. The insertion bar may include a first opening into which the handle can be inserted and through which the handle can be attached to the insertion bar. The handle can be used to rotate the drilling device about an axis passing through the tube and insertion bar, in order to drill the drilling device into the ground. The handle may include a first portion which has outer threads and a second portion which has inner threads. The first portion of the handle may be inserted through the first opening in the insertion bar and into the second portion of the handle in order to attach the handle to the insertion bar.

The apparatus may further include a device for holding multiple poles. The device for holding multiple poles can be inserted into the first pole receiver. A table device which can be inserted into the first pole receiver may also be provided. The table device may also include a second pole receiver which may include a latching mechanism for holding a pole.

The present invention, in one or more embodiments, also includes a method comprising the steps of forming a point at a first end of a drilling device, attaching a second end of the drilling device to a first end of a tube, attaching a latching device to a second end of the tube, and inserting a first end of an insertion bar into the second end of the tube so that the insertion bar lies at least partially in the tube. The latching device can set a location of the insertion bar with respect to the tube so that a height is set, wherein the height is measured from a second end of the insertion bar to the point at the first end of the drilling device.

DETAILED DESCRIPTION OF THE DRAWINGS

Figure 1:
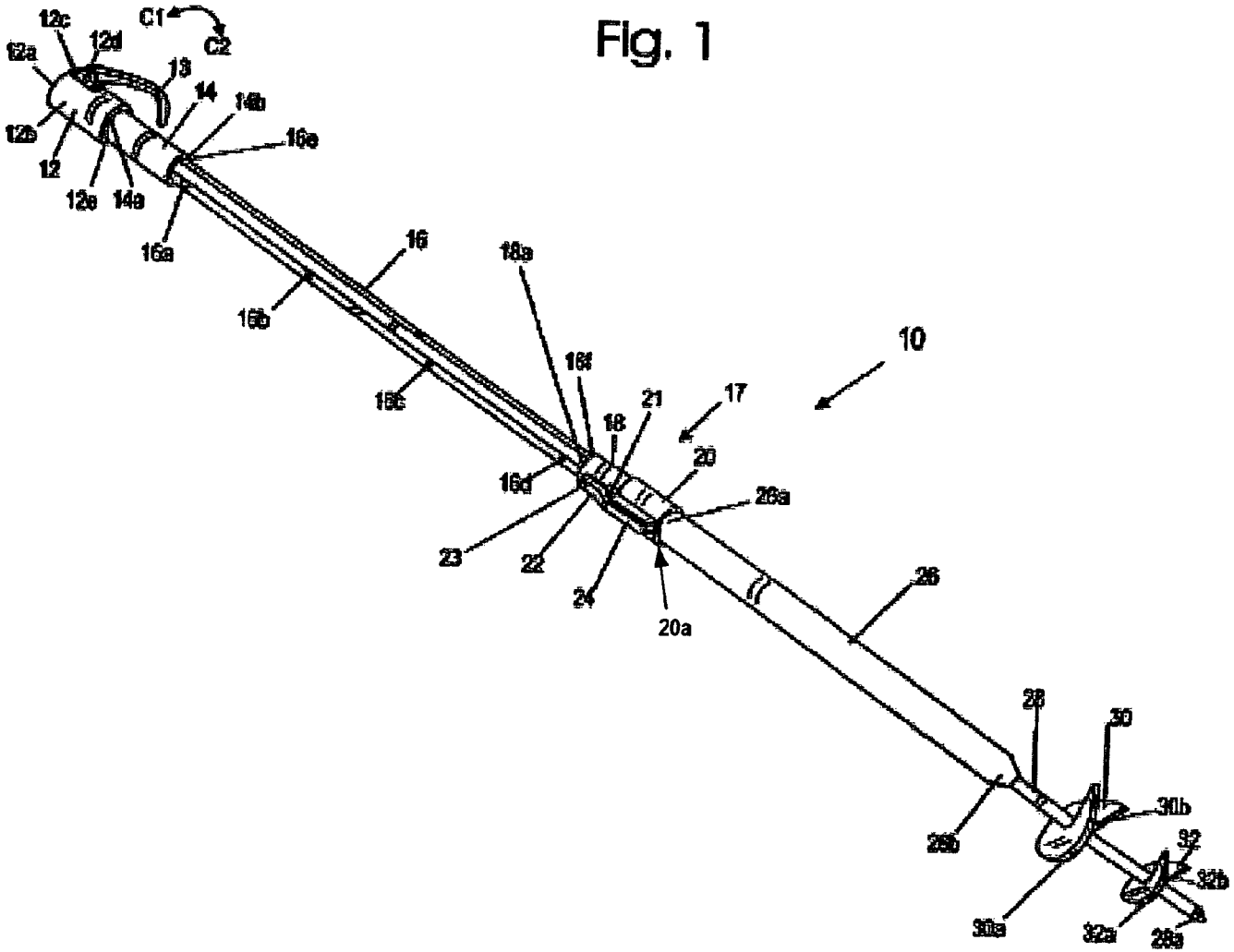
FIG. 1 shows a perspective view of an anchoring apparatus for use in accordance with an embodiment of the present invention.

FIG. 1 shows a perspective view of an anchoring apparatus 10 for use in accordance with an embodiment of the present invention. The anchoring apparatus 10 includes a pole receiver 12, a tube 14, a bar 16, a latching device 17, a tube 26 and a bar 28.

The pole receiver 12 may be a typical pole receiver for receiving, for example a beach umbrella pole. The pole receiver 12 may include a hollow tube 12*b* having an opening 12*a* into which a pole or stem can be inserted. The pole receiver 12 may include a latching mechanism 13 that may be attached via a pin 12*d* to an extension 12*c*, which is attached to the outer surface of the tube 12*b*. As known in the art of beach umbrellas, for example, the latching mechanism 13 can rotate about the pin 12*d* in directions C1 or C2. As known in the art of beach umbrellas, for example, when the latching mechanism is rotated in the direction C2 so that the latching mechanism 13 is in the rotational position shown in FIG. 1, a protrusion (not shown) is pushed into the hollow tube 12*b* making it difficult to remove a pole, if one has already been inserted into the hollow tube 12*b*, or making it difficult to insert a pole into the hollow tube 12*b*, if one has not been inserted into the hollow tube 12*b*.

The tube 14 has an end 14*a* that is fixed to an end 12*e* of the pole receiver 12. The tube 14 may have an end 14*b* that is fixed to an end 16*e* of the bar 16. The tube 14 may be a hollow tube. The bar 16 may be a solid metal bar with the exception of holes 16*a*, 16*b*, 16*c* and 16*d*. The hole 16*a* is typically larger than the holes 16*b-d*. The holes 16*b-d* are typically the same size. The hole 16*a* typically goes all the way through the bar 16 while the holes 16*b-d* do not typically go all the way through the bar 16.

The latching device 17 includes a tube 18, a tube 20, a first portion of a latching mechanism 22 and a second portion of a latching mechanism 24. The latching device 17 also includes a portion or protrusion 23, which can be inserted into one of the holes 16*b-d* to hold the bar or insertion bar 16 at a certain location with respect to tube 26 to set a height. The first portion 22 may in a normal state press the protrusion 23 towards the bar 16 and when the bar 16 is slid under the protrusion 23 so that the protrusion 23 is aligned with one of holes 16*b-d*, the protrusion 23 becomes inserted into the particular holes of holes 16*b-d*. The bar 16 is then fixed with respect to tube 26. The bar 16 can be moved by pressing on portion 24, which pivots the combination of portion 24 and 22 about pivot point 21 so that when portion 24 is pressed downwards, portion 22 (and protrusion 23) come upwards or away from the bar 16, so that protrusion 23 exits the particular hole of holes 16*b-d* allowing the bar 16 to again slide within tube 26.

When the bar 16 is extended out as far as possible from tubes 18, 20, and 26, end 16*f* of the bar 16 will lie just inside the tube 18. A stop (not shown) within the tube 18 may be used to prevent the end 16*f* of the bar 16 from coming completely out of the combination of the tubes 18, 20 and 26.

The first portion 22 of the latching mechanism may include a protrusion (not shown) that is inserted through an opening in the tube 18, in a manner known in the art. This protrusion can be inserted into any of the openings 16*b*, 16*c*, or 16*d* to latch the bar 16 into a position with respect to the tubes 18, 20 and 26. In this manner the height of the anchoring apparatus 10 can be adjusted.

The latching device 17 is typically fixed at an end 20*a* to an end 26*a* of the tube 26. The tube 26 is typically hollow and the bar 16 can be inserted into the tube 26, to adjust the height of the anchoring apparatus 10. The tube 26 has a tapered end 26*b* which is connected to bar 28. The bar 28 is typically a solid bar made of aluminum. The bar 28 has fixed to it a drill or auger device 30 having sharp edges 30*a* and 30*b*, and a drill or auger device 32 having sharp edges 32*a* and 32*b*. Typically the drill or auger device 30 is larger in diameter than the drill or auger device 32. Further drill or auger devices may be provided on the bar 28, or the entire bar 28 may be replaced by a drill bit, drill device, auger device or threaded screw type device. The combination of the bar 28 and the auger devices or bits 30 and 32 may be considered a drilling device, drill device or auger device.

Figure 2:
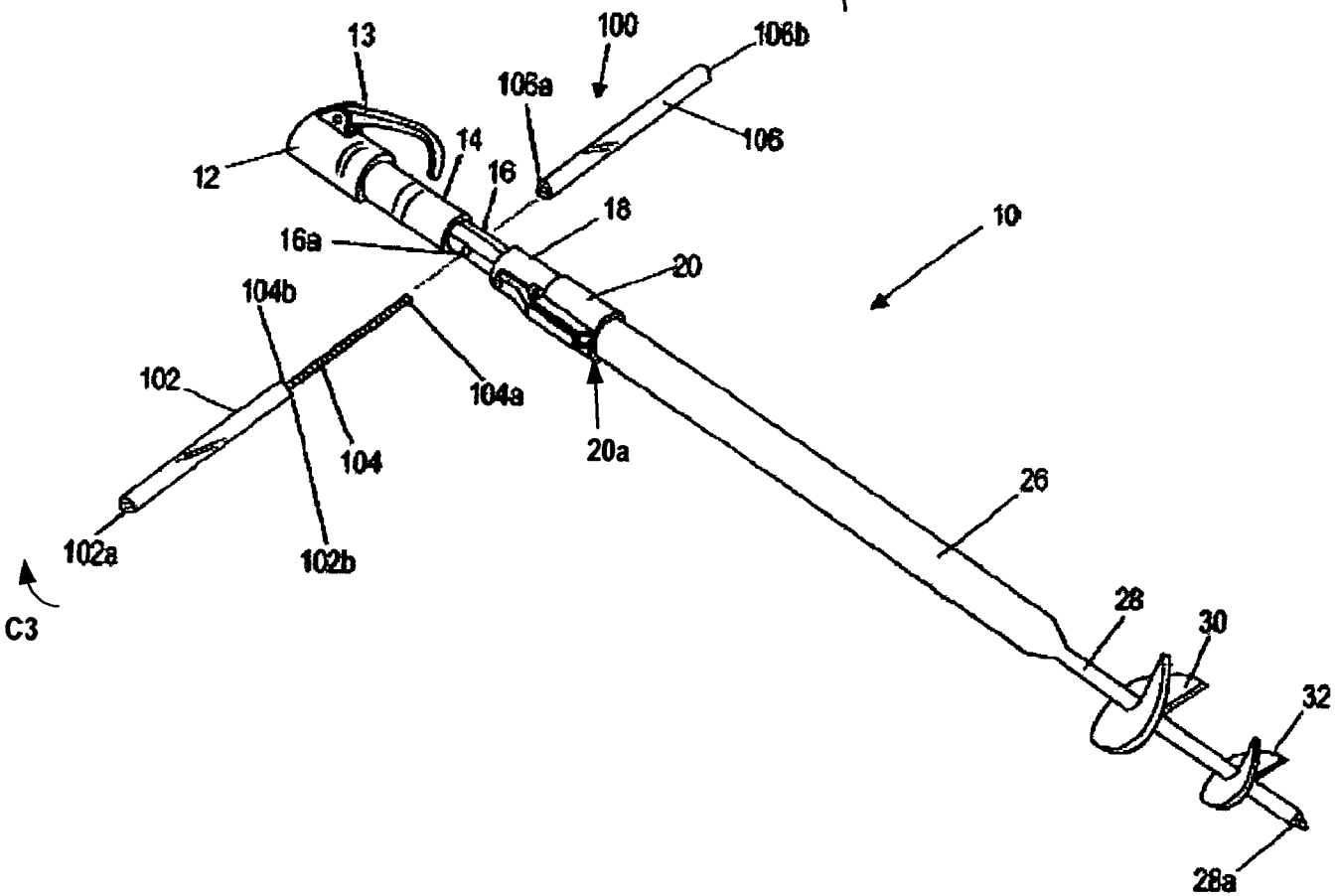
FIG. 2 shows a perspective view of a handle and the anchoring apparatus of FIG. 1.

FIG. 2 shows a perspective view of a handle 100 and the anchoring apparatus 10 of FIG. 1. The handle 100 includes portions 102, 104 and 106. The portions 102 and 106 may be wooden bars or handles. The portion 104 may be a threaded portion in the form of a screw or threaded portion of a bolt. An end 104*b* of the portion 104 may be fixed to an end 102*b* of the portion 102. The portion 102 may have a closed end 102*a*. The portion 106 may have an end 106*a* with a threaded internal opening for receiving external threads of the portion 104. The portion 106 may have a closed end 106*b*. The end 104*a* can be inserted into the end 106*a* of the handle 100.

Figure 3:
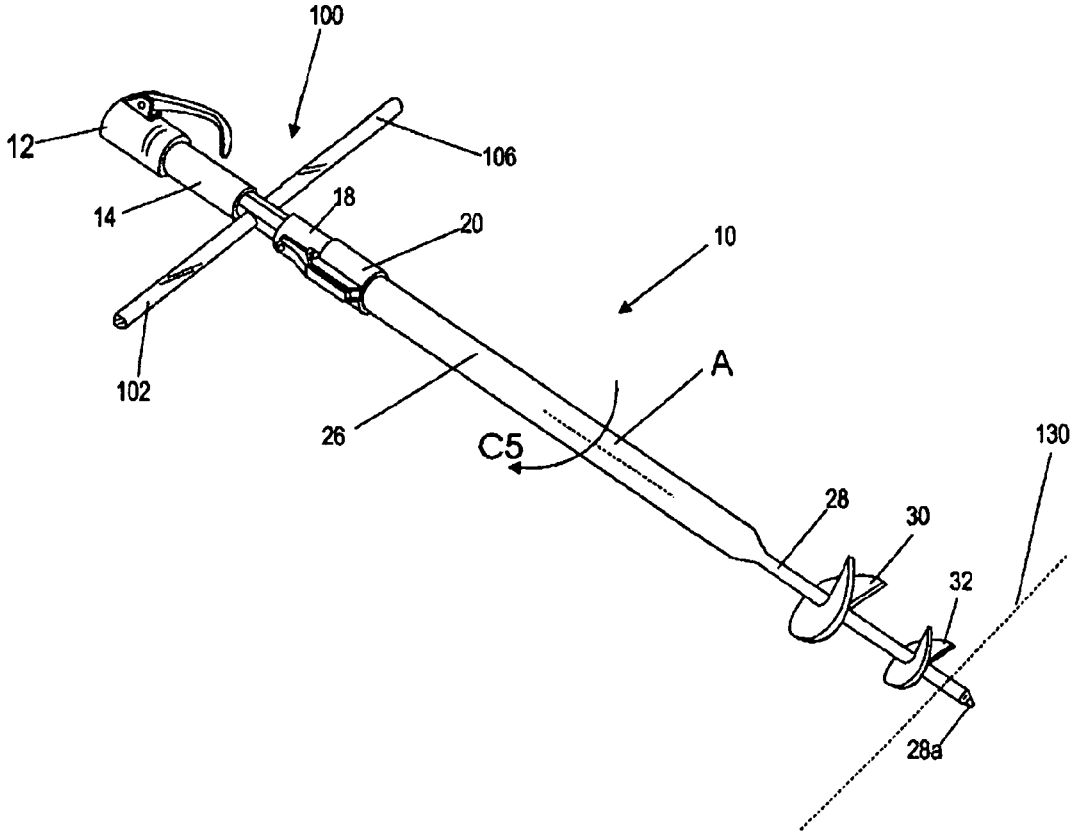
FIG. 3 shows a perspective view of the handle of FIG. 2 attached to the anchoring apparatus of FIG. 1.

FIG. 3 shows a perspective view of the handle 100 of FIG. 2 attached to the anchoring apparatus 10 of FIG. 1. In operation, end 104*a* of the portion 104 is inserted into the opening 16*a* of the bar 16 and through the bar 16. The end 104*a* is then inserted into the opening 106*a* and into the portion 106. The portion 104 is then screwed into the opening 106*a* of the hollow portion 106 by turning portion 102 in a clockwise direction, C3, while the portion 106 remains still or is turned in a counterclockwise direction C4. The portion 104 can also be screwed into the opening 106*a* by turning portion 106 in a counterclockwise direction, C4, while the portion 102 remains still.

After the handle 102 has been attached to the apparatus 10 as shown in FIG. 3, the combination handle 100 and anchoring apparatus 10 can be used to anchor, insert and/or drill the anchoring apparatus 10 into ground 130. First, an individual may push down on the handle 100 in the direction of the ground 130 to insert an end or point 28*a* of the apparatus 10 into the ground 130. Then, an individual may turn the handle in the direction C5 about an axis A (passing longitudinally through tube 26 and bar 16). This causes the sharp edges, 32*b* and then 32*a*, of the drill or auger device 32 to dig into the ground 130 and help the apparatus 10 to be essentially pulled down into or screwed down into the ground 130. After the drill or auger device 32 has been pulled far enough into the ground 130, the sharp edges 30*b* and then 30*a* of the drill or auger device 30 dig into the ground 130 and also help the apparatus be pulled down into or screwed down into the ground 130. When the bar 28 has been inserted far enough into the ground 130 so that the tube 26 and apparatus 10 is firmly anchored into the ground 130, such as, for example, when both drill or auger devices 30 and 32 are in the ground and the end 26*b* of the tube 26 is at least touching the ground 130, the individual may stop turning the handle 100. The individual may then unscrew the portion 102 from the portion 106, by, for example, turning the portion 102 in a direction C4 while keeping the portion 106 still or turning the portion in a clockwise direction C3.

Figure 4:
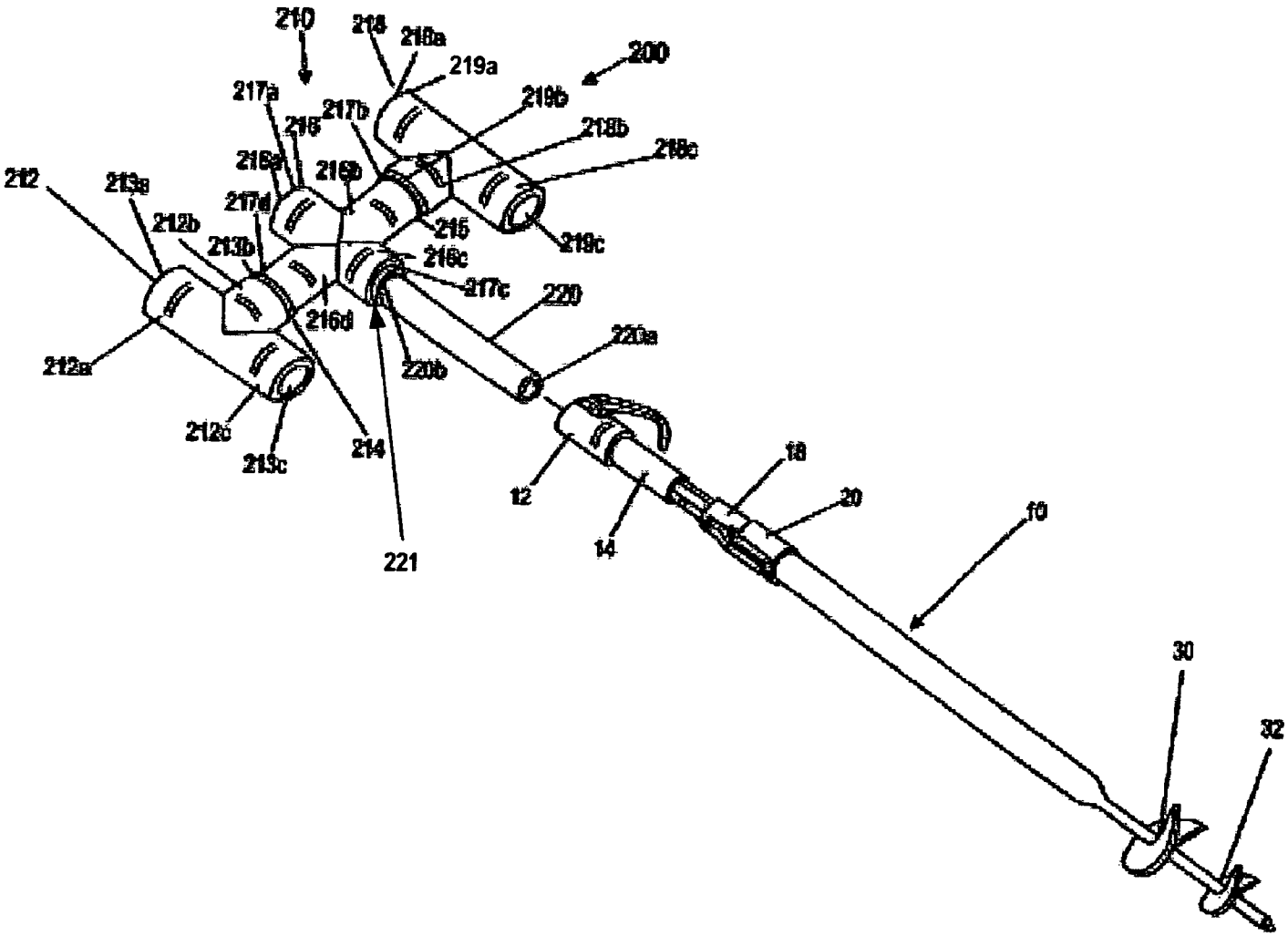
FIG. 4 shows a perspective view of a device for holding multiple poles and the anchoring apparatus of FIG. 1.

After the anchoring apparatus 10 has been inserted into ground, such as ground 130, various devices may be inserted into the anchoring apparatus 10. FIG. 4 shows a perspective view of a device 200 for holding multiple poles and the anchoring apparatus 10 of FIG. 1. The device 200 includes a device 210 and a tube 220. The device 210 includes a T-tube coupler 212, a connector 214, a cross tube coupler 216, a connector 215 and a T-tube coupler 218.

The T-tube coupler 212 includes branches 212*a*, 212*b* and 212*c*. Branches 212*a*, 212*b* and 212*c* include ends 213*a*, 213*b* and 213*c*, respectively. The cross-tube coupler 216 includes branches 216*a*, 216*b*, 216*c* and 216*d*, having ends 217*a*, 217*b*, 217*c* and 217*d*, respectively. The T-tube coupler 218 may be identical to the T-tube coupler 212. The T-tube coupler 218 includes branches 218*a*, 218*b* and 218*c*. Branches 218*a*, 218*b* and 218*c* include ends 219*a*, 219*b* and 219*c*, respectively.

Branch 212*b* of the T-tube coupler 212 is connected to branch 216*d* of the cross-tube coupler 216 at ends 213*b* and 217*d*. Branch 218*b* of the T-tube coupler 218 is connected to the branch 216*b* of the cross tube coupler 216 at ends 218*b* and 217*b*. The branch 216*c* of the cross tube coupler 216 is connected to the coupler 221 at end 217*c*. The coupler 221 is connected to end 220*b* of the tube 220.

Figure 5:
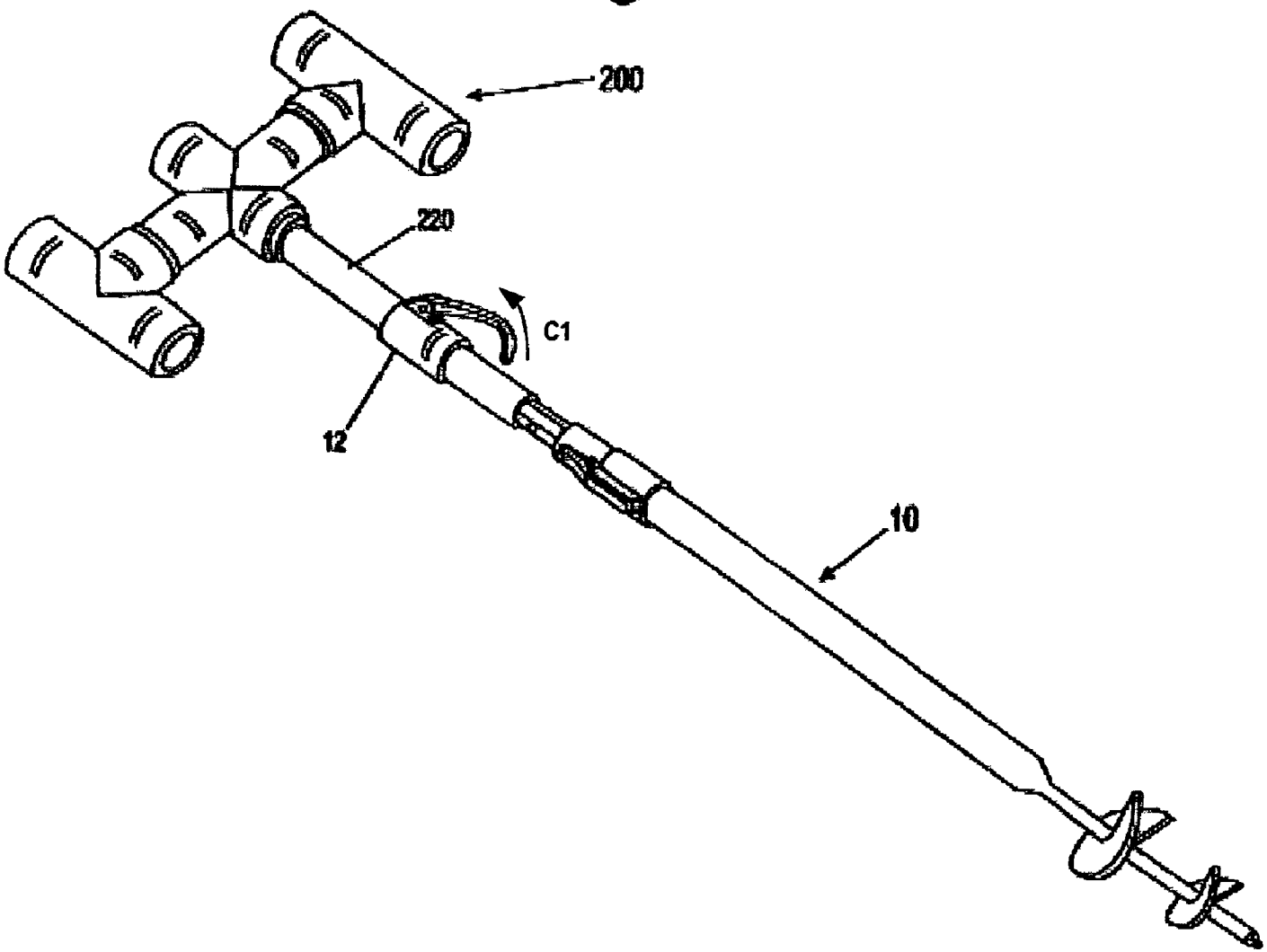
FIG. 5 shows a perspective view of the device for holding multiple poles of FIG. 4 attached to the anchoring apparatus of FIG. 1.

FIG. 5 shows a perspective view of the device 200 for holding multiple poles of FIG. 4 attached to the anchoring apparatus 10 of FIG. 1. In operation, the device 200 can be inserted into the apparatus 10 by inserting the end 220*a* into the opening 12*a* of the pole receiver or latching device 12. The latch or lever 13 would normally need to be in an upward position or rotated in the direction C1. After the device 200 has been inserted into the apparatus 10, a first pole, such as a fishing pole, can be inserted into opening or end 213*a* of the branch 212*a* of the T-tube coupler 212. In addition, a second pole, such as another fishing pole, can be inserted into the opening or end 219*a* of the branch 218*a* of the T-tube coupler 218.

Figure 6:
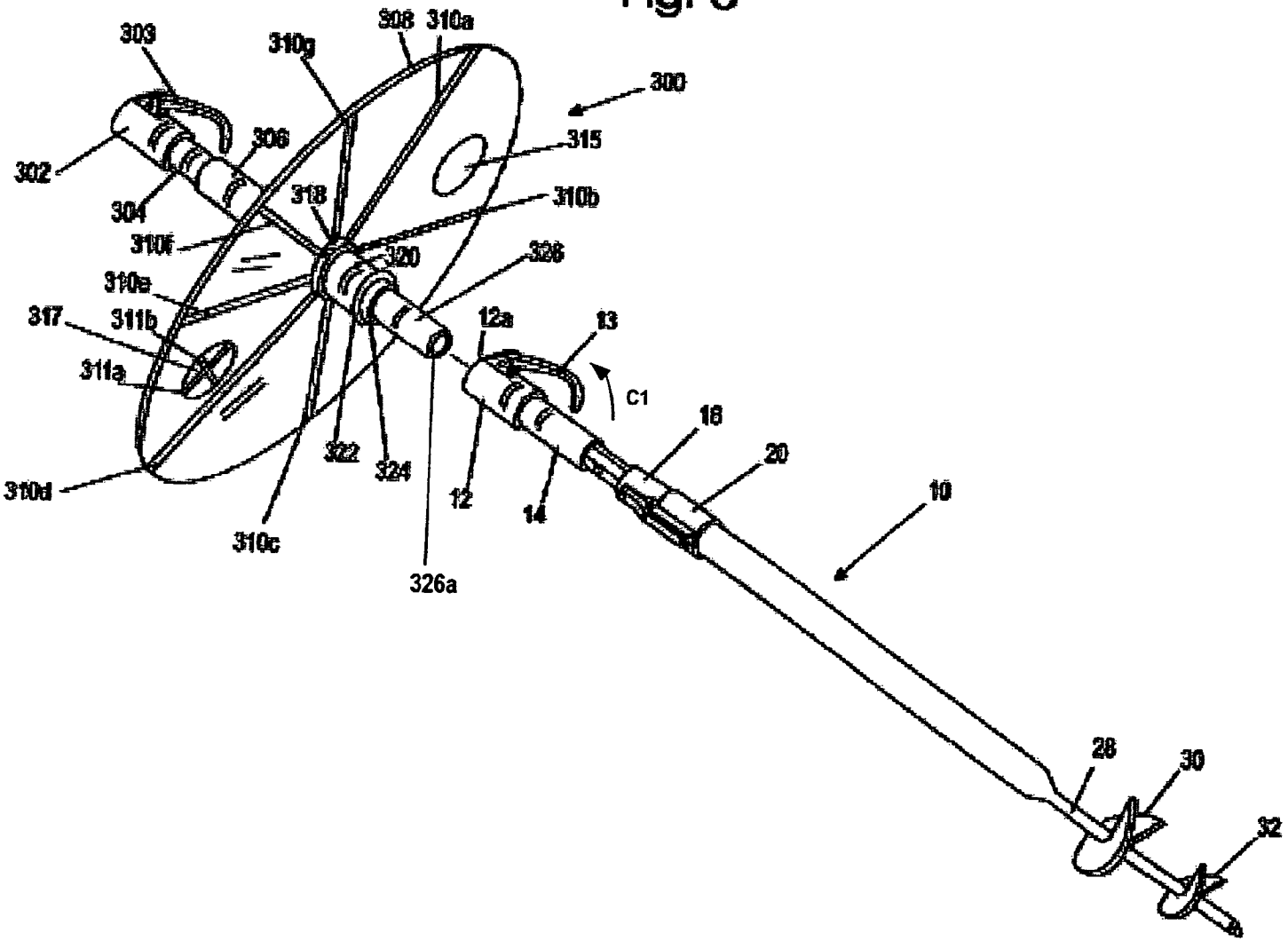
FIG. 6 shows a perspective view of a table and pole receiver device and the anchoring apparatus of FIG. 1.

FIG. 6 shows a perspective view of a table and pole receiver device 300 and the anchoring apparatus 10 of FIG. 1. The table and pole receiver device 300 includes a latching device 302 having a latch or lever 303, a tube 304, a tube 306, a table 308, a coupler 318, a tube 320, a coupler 322, a coupler 324 and a tube 326. The table 308 may include reinforcing ribs 310*a*, 310*b*, 310*c*, 310*d*, 310*e*, 310*f* and 310*g* which provide the table 308 with rigidity. Each of the ribs 310*a-g* may provide one quarter of an inch in extra depth. The table 308 may have openings 315 and 317 (partially shown) that may be used, for example, as cup holders. The openings, such as opening 317, may include straps, such as straps 311*a* and 311*b*, that may be used to hold a cup or beverage container.

The pole receiver or latching device 302 may be similar or the same as pole receiver or latching device 12. The tube 304 is attached to latching device 302. The tube 306 is attached to tube 304. The tube 306 and coupler 318, along with optional further couplers, may keep table 308 in a fixed position with respect to the tube 306 and the coupler 318. The coupler 318 is fixed to the tube 320. The tube 320 is fixed to the coupler 322, which is fixed to the coupler 324. The coupler 324 is fixed to the tube 326.

Figure 7:
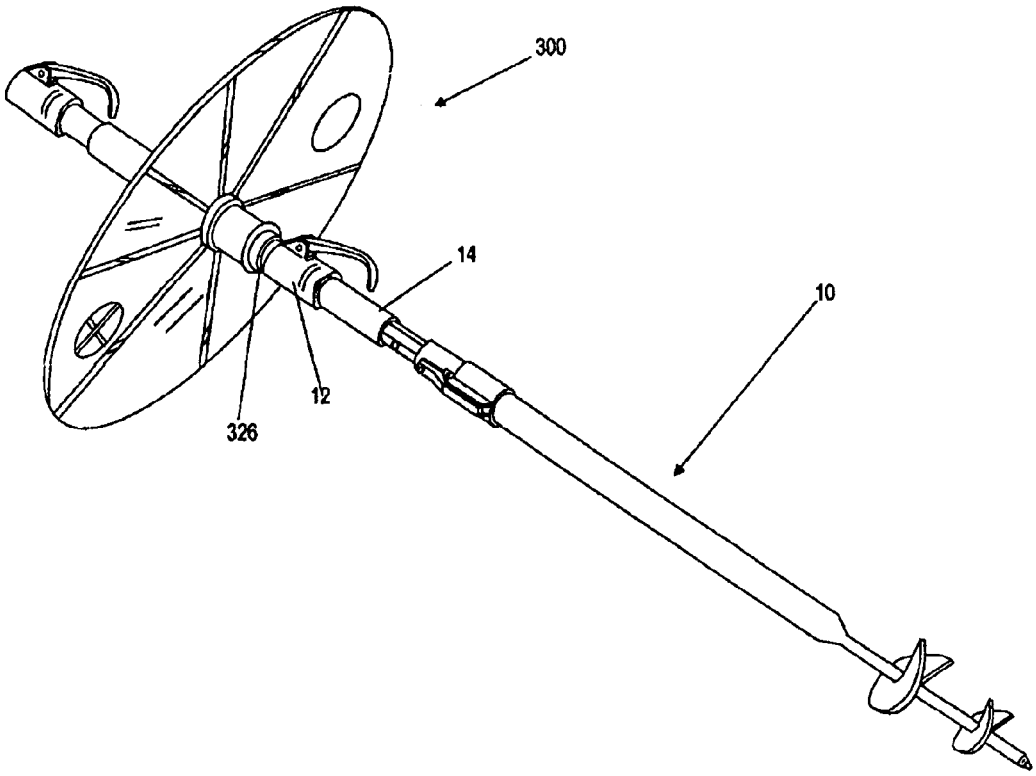
FIG. 7 shows the table and pole receiver device attached to the anchoring apparatus of FIG. 1.

In operation, the table and pole receiver device 300 can be attached to the anchoring apparatus 10 by inserting an end 326*a* of the tube 326 into the opening 12*a* of the pole receiver 12. As for the apparatus of FIGS. 4 and 5, typically the lever or latching device 13 would need to be turned upwards in a direction C1 in order to insert tube 326. Thereafter, a pole, such as an umbrella pole, can be inserted into the pole receiver 302. FIG. 7 shows the table and pole receiver device 300 attached to the anchoring apparatus 10 of FIG. 1.

The length from end or opening 12*a* of pole receiver 12 to the point 28*a* of drilling bar 28 may be sixty one inches when the bar 16 is in its fully extended position as in FIG. 1. The opening 12*a* of the pole receiver may be one and one eighths inches. The auger or drilling device 32 may have an outer diameter or largest diameter of one and one eighths inches. The auger or drilling device 30 may have an outer or largest diameter of two inches. The augers or drilling devices 30 and 32 may be soil or sand augers. When the bar 16 is inserted as far into tube 26 as it can go, as in FIG. 2, the length from end or opening 12*a* of pole receiver 12 to the point 28*a* of the drilling bar 28 may be forty-three inches. The length from an opening 18*a* in tube 18 into which bar 16 in inserted to the point 28*a* of drill bar 28, may be thirty-seven inches. The drill bar 28 may have a three-quarters of an inch diameter. In one embodiment a single three and three-quarters of an inch auger device may be supplied instead of the two auger devices 30 and 32.

The table 308 may be a twenty and one quarter inch diameter circular table. The opening 315 may be a three and one eighths of an inch diameter circular opening. The threaded portion 104 of the handle 100 may have a three eighths of an inch diameter. The portions 102 and 106 may be cylindrical bars having one and one eighths inch diameters. The sharp edges 30*a-b*, and 32*a-b* on the auger devices 30 and 32, respectively, may be beveled or serrated for cutting.

The anchoring apparatus 10, alone or in combination with the additional components shown in FIGS. 1-7, can be called a multi-purpose anchoring device. The apparatus 10 provides for the secure placement of a variable length pole, wherein the variable length pole may include the tube 26 and the insertion bar 16, and the length is varied by use of latching device 17. The bar 28 and auger devices 30 and 32 may be considered a boring mechanism for securing the apparatus 10 in a variety of soil densities, from loose sand to hard-pack earth. Secondary functions are accommodated by pole receiver 12, which can be called an integral secure locking mechanism. The pole receiver 12 can receive various accessory poles including a typical beach umbrella pole, a fishing pole, a table top, a volley ball/bad mitten pole, sign holder pole or a lantern hanger.

A plurality of the apparatus 10, such as four apparatus 10 may be used to provide four point support for a large rectangular table top, temporary perimeter fence posts, tenting supports, etc.

The apparatus 10 is superior to a multi-turn screw design. The auger devices 30 and 32, which are typically soil cutting, serrated flanges of differing diameters, require significantly less torque strength applied to handle 100 for even deeper insertion and secure holding power. Unlike a mufti-turn screw approach, the apparatus 10 provides for minimal soil disturbance, further enhancing its anchor grip.

The bar 16 may be made of aluminum. The tube 26 may be made of lightweight non rusting fiberglass or nylon. The bar 16 may be a hexagonal shaft. The hexagonal design prevents rotation of the inner shaft or bar 16 within the outer shaft or tube 26 to insure ease of use via the automatic alignment of the shaft or bar 16 and maximizes unit strength during soil placement.

The pole receiver 12 has a single lever 13, which acts as a thumb actuated compression locking mechanism to securely fasten the above cited accessories, such as beach umbrella pole etc. The compression locking feature permits three hundred and sixty degree rotation of its accessories.

The handle 100, typically located on the proximal end of the inner shaft or bar 16 (just behind the locking mechanism or latching device 17), provides a comfortable grip and maximizes torque for ease of insertion.

Figure 8A:
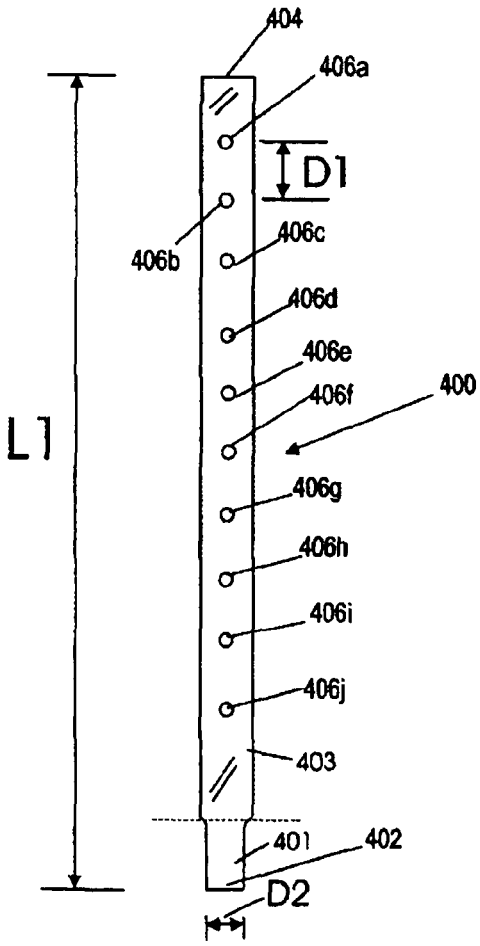
FIG. 8A shows a front view of a pole.
Figure 8B:
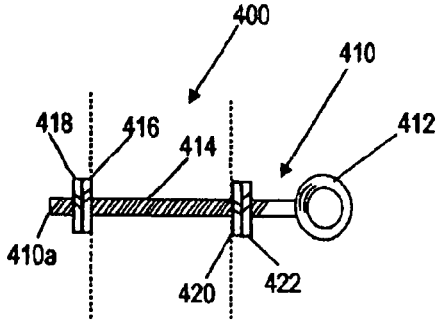
FIG. 8B shows a side view of an attachment device for attaching to the pole of FIG. 8A.

FIG. 8A shows a front view of a pole 400. FIG. 8B shows a side view of an attachment device 410 inserted through the pole 400. The pole 400 may be used for attaching one end of a volleyball net or similar device. The pole 400 may have ends 402 and 404. The end 402 can be inserted into the opening or end 12*a* of the pole receiver 12 of apparatus 10. The pole 400 may include holes 406*a*, 406*b*, 406*c*, 406*d*, 406*e*, 406*f*, 406*g*, 406*h*, 406*i* and 406*j*.

The attachment device 410 can be attached to the pole 400 as shown by FIG. 8B. The attachment device 410 may include a portion 412 and a portion 414. The portion 412 may be an eyehook and the portion 414 may be a bolt or a portion of a bolt with outer threads. An end 410*a* of the portion 414 can first be inserted through a bolt 422 and a washer 420 as shown in FIG. 8B. The end 410*a* of the portion 414 can then be inserted through the pole 400 through one of the holes 406*a-j*. A washer 416 can then be placed over the end 410*a* and then a bolt 418 can be placed over the end 410*a*. The result is that the pole 400, whose location is shown by dashed lines in FIG. 8B, is sandwiched between the washers 416 and 420. A first string or rope from a volleyball net (not shown) can then be attached to the eyehook 412, thereby attaching the net to the pole 400. Another attachment device like 410 can be used to attach a second string of the volleyball net (not shown) at another location on the pole 400. A second pole, similar to the pole 400, and a second anchoring apparatus, similar to the anchoring apparatus 10, can be used to secure the other end of the volleyball net in a similar manner.

The pole 400 may have a length, L1, which may be five feet. The distance between two adjacent holes of holes 406 *a-j* may be D1, which may be two inches. The pole 400 may have a section 403 and a narrower section 401. The section 401 may have an outer diameter of D2, which may be slightly less than the inner opening diameter of opening 12*a* of the pole receiver 12, so that the pole section 401 snugly fits within the pole receiver 12. Each of holes 406 *a-j* may have a one-quarter inch inner diameter.

Figure 9B:
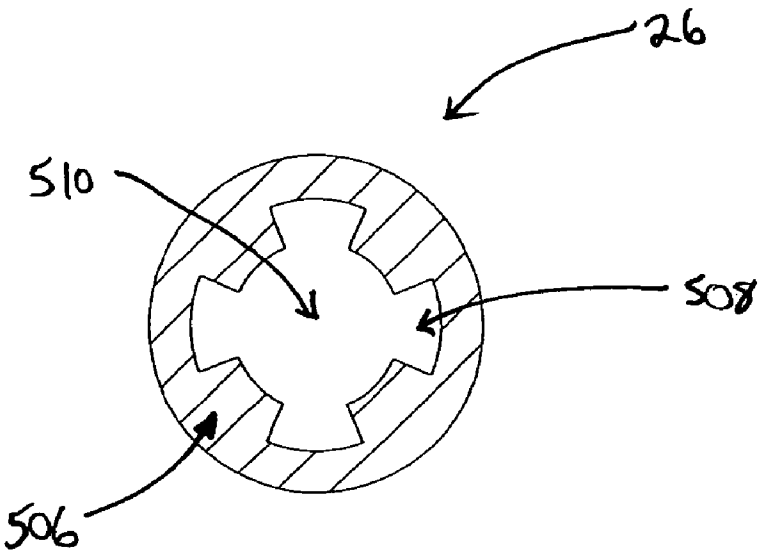
FIG. 9B shows a cross-sectional view of a tube.
Figure 9A:
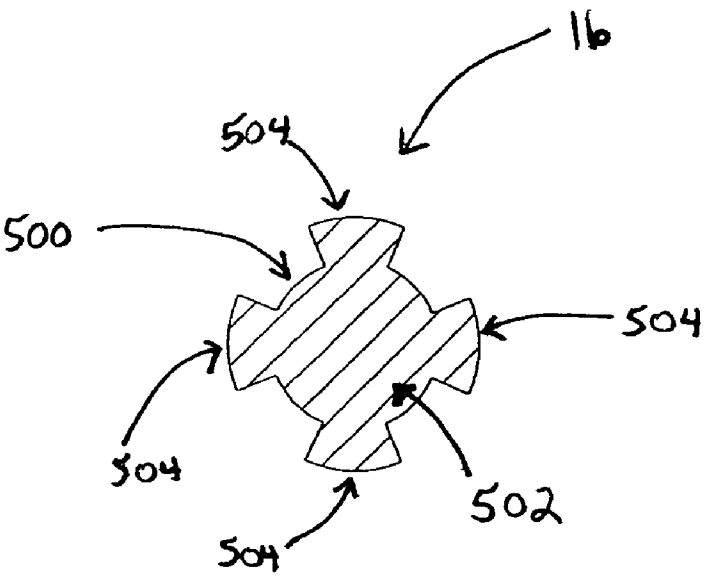
FIG. 9A shows a cross-sectional view of an insertion bar.

FIG. 9A shows a top view of one embodiment in which the bar 16 has a cross-sectional shape 500 featuring a core 502 coextensive with the axis A and oblong protrusions 504 extending radially from the core 502 and axis A. In other embodiments, the bar 16 may have a cross-sectional shape of a polygon or any object having protrusions.

FIG. 9*b* shows a top view of one embodiment of the tube 26. The tube 26 may have an interior portion 506 consisting of solid material, such as lightweight non-rusting fiberglass or nylon, and a cavity 508 in the solid material with a cross-sectional shape 510 corresponding to the cross-sectional shape 500 of the bar 16. In this manner, the cavity 508 may be dimensioned such that the bar 16 may be slideably inserted within the tube 26. Insertion of the bar 16 having shape 500 into the cavity 508 having cross-sectional 510 within the tube 26 prevents rotation of the bar 16 within the tube 26, has greater resistance to jamming and provides automatic alignment of the bar 16 and the tube 26 to maximize unit strength. In other embodiments, the cavity 508 may have a cross-sectional shape of a polygon or any object having protrusions.

Figure 10:
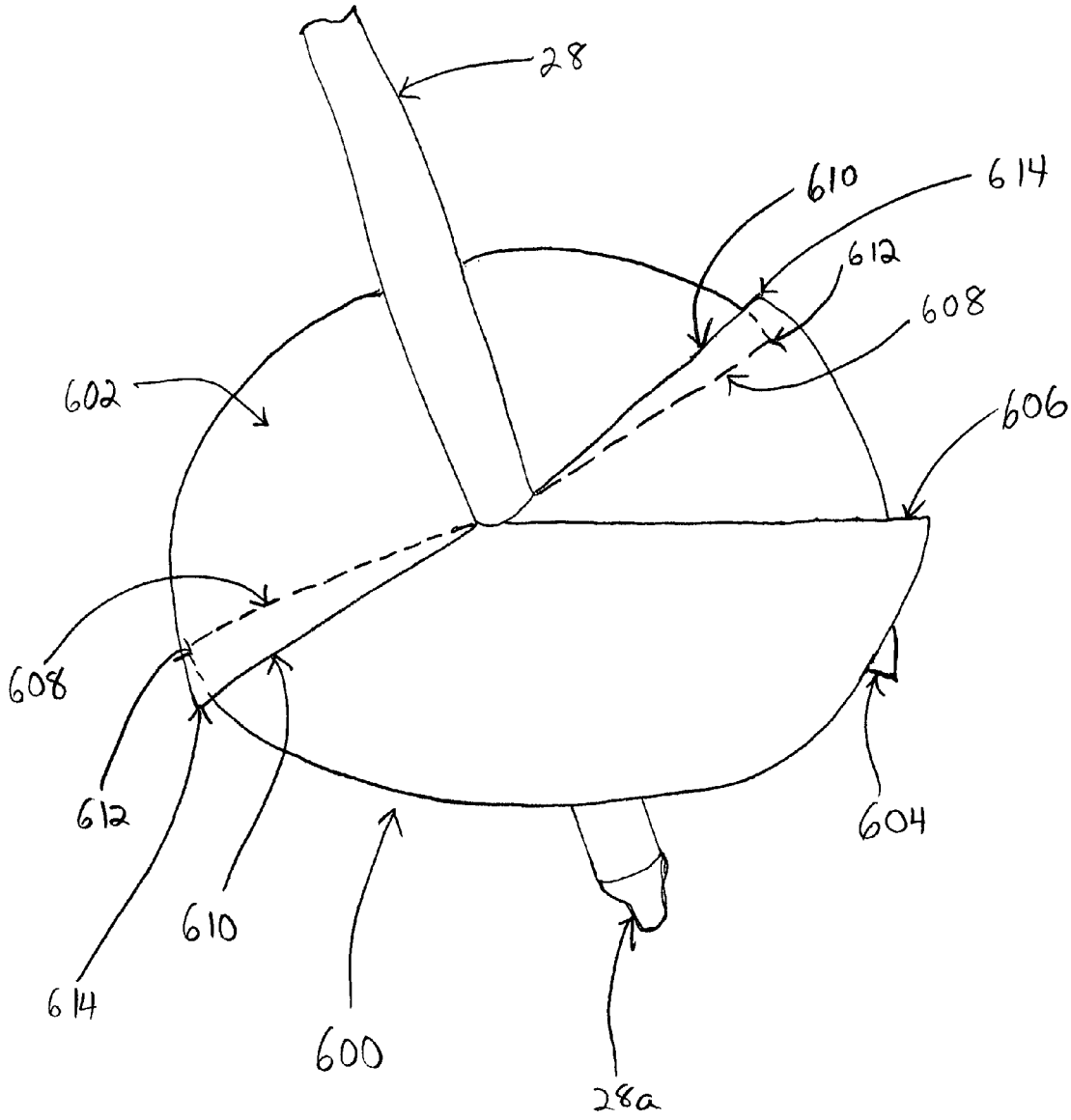
FIG. 10 shows a perspective view of a modified auger device having supplemental cutting blades.
Figure 10A:
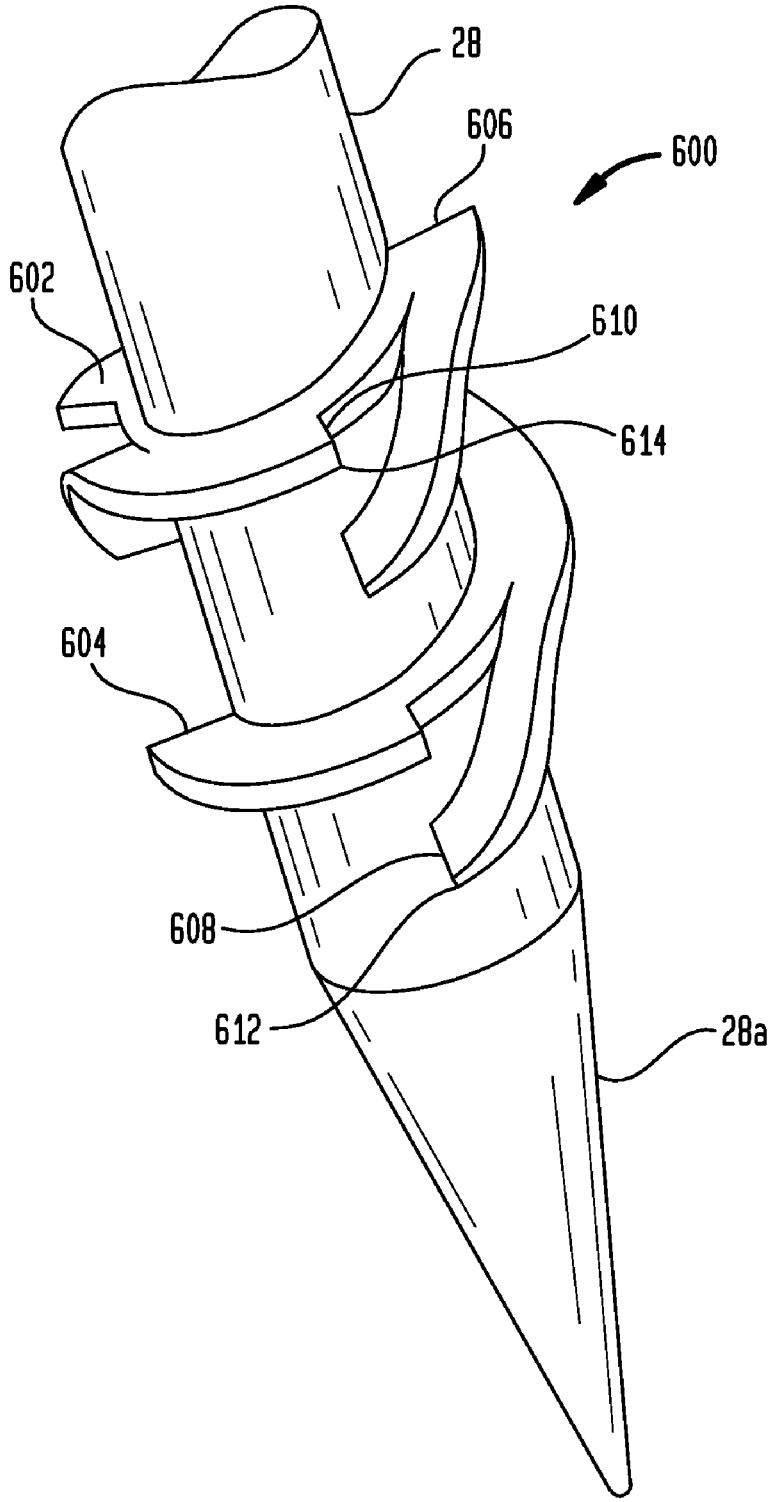

FIG. 10 shows a perspective view of a modified auger device 600 fixed to the bar 28. The modified auger device 600 has a planar surface 602 having a leading edge 604, a terminal edge 606, supplemental cutting edges 608 and trailing edges 610. The supplemental cutting edges 608 and trailing edges 610 may extend radially away from the bar 28 and are formed as discontinuities or breaks in the planar surface 602. The supplemental cutting edges 608 and trailing edges 610 are adjacent. The supplemental cutting edges 608 have leading distal points 612. The trailing edges 610 have trailing distal points 614. The leading distal points 612 are closer than the trailing distal points 614 to the point 28*a* of the drilling bar 28. The trailing edges 610 may overlap the supplemental cutting edges 608.

Figure 11:
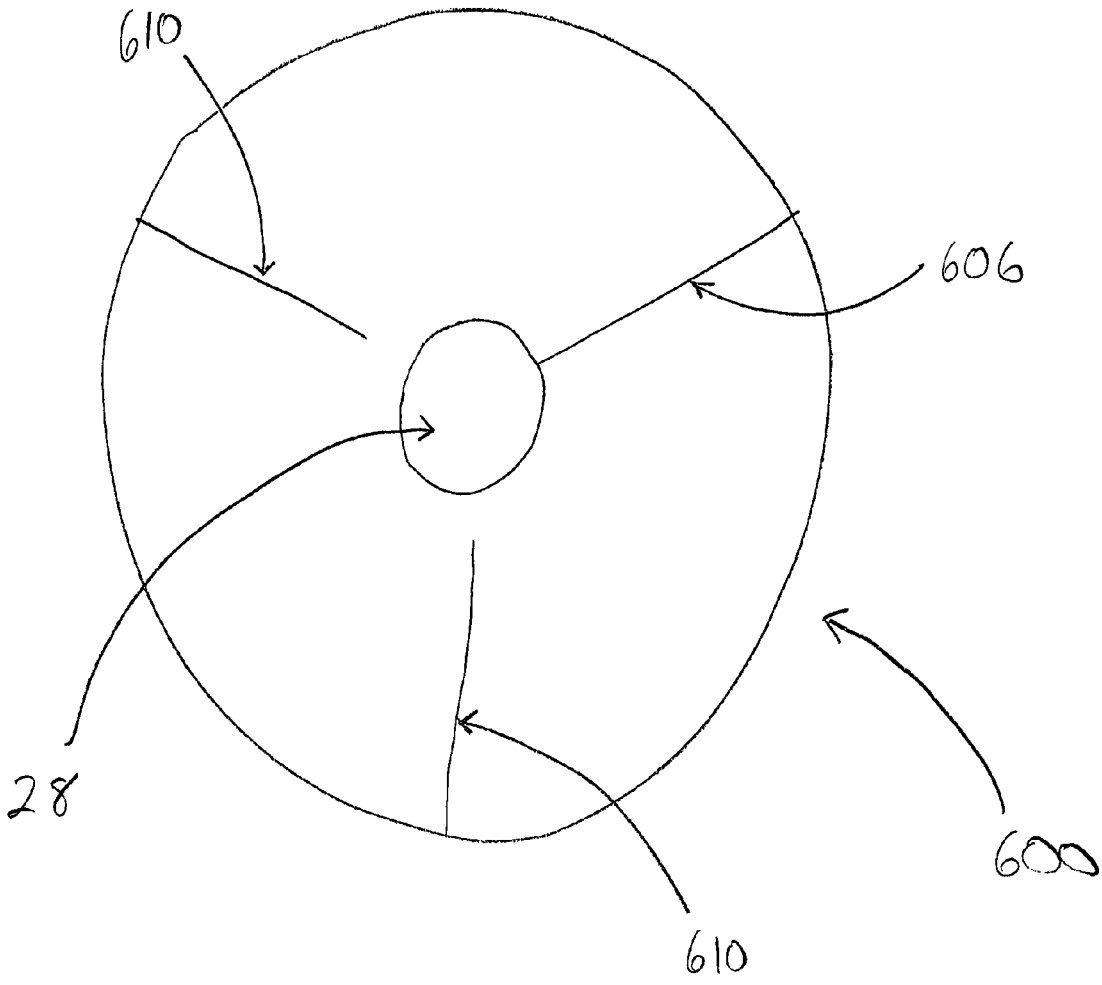
FIG. 11 shows a top view of a modified auger device having supplemental cutting blades.

FIG. 11 shows a top view of the modified auger device 600.

The modified auger device 600 provides deeper insertion and greater holding power in soil, with minimal soil disturbance, in comparison to prior art devices.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a drilling device having a first end and a second end, wherein a point is located at the first end of the drilling device, wherein the drilling device comprises a drill bar and a modified auger device disposed on said drill bar, wherein said modified auger, device comprises a helical member comprising a leading edge, a terminal edge, and a common surface extending between the leading edge and the terminal edge that is continuous along the length of the helical member over at least a portion of the radius of the helical member, wherein a downwardly oriented flap is formed in said helical member as a partial discontinuity in the surface of the helical member between the leading edge and the terminal edge, such that the flap defines a supplemental leading edge disposed on said flap and a supplemental trailing edge disposed on at least a portion of the radius of the helical member, wherein said supplemental leading edge and said supplemental trailing edge are located on the same side of said drill bar, said supplemental leading edge is proximal to and substantially aligned with said supplemental trailing edge in the direction of the longitudinal axis of the drill bar, and there is substantially no offset between said supplemental leading edge and said supplemental trailing edge in the direction of the transverse axis of the drill bar;

a tube having a first end and a second end, wherein the first end of the tube is connected to the second end of the drilling device, and having a solid interior portion forming a longitudinal cavity having a cross-sectional shape;

an insertion bar having a first end and a second end, the first end of the insertion bar slideably inserted into the second end of the tube so that the insertion bar lies at least partially in the tube and has a cross-sectional shape corresponding to the cross-sectional shape of the cavity formed in the interior portion of the tube, so that a substantial portion of the insertion bar is slideably insertable within the tube and the amount of the insertion bar that is inserted within the tube is selectably adjustable; and a latching device affixed to said second end of said tube which can set a location of the insertion bar with respect to the tube so that a height is set, wherein the height is measured from the second end of the insertion bar to the point at the first end of the drilling device.

2. The apparatus of claim 1 wherein the cross-sectional shape of the longitudinal insert and the cavity formed by the solid interior portion of the tube comprises a cross-sectional shape selected from the group consisting of polygons and cross-sectional shapes having protrusions.

3. The apparatus of claim 2 further comprising a first pole receiver connected at the second end of the insertion bar; and wherein the first pole receiver can receive and retain a pole.

4. The apparatus of claim 3 wherein the first pole receiver includes a latching mechanism for retaining a pole.

5. The apparatus of claim 1 wherein the insertion bar has a length and the insertion bar has a plurality of holes dispersed along the length of the insertion bar; and wherein the latching device includes a portion which can be inserted into any one of the plurality of holes in order to set the location of the insertion bar with respect to the tube so that the height is set.

6. The apparatus of claim 1 further comprising a handle; wherein the insertion bar includes a first opening, and wherein the handle can be inserted into the first opening and attached to the insertion bar; and wherein the handle can be used to rotate the drilling device about an axis passing through the tube, in order to drill the drilling device into the ground.

7. The apparatus of claim 6 wherein the handle includes a first portion which has outer threads and a second portion which has inner threads; and wherein the first portion of the handle is inserted through the first opening in the insertion bar and into the second portion of the handle in order to attach the handle to the insertion bar.

8. The apparatus of claim 3 further comprising a table device; and wherein the table device can be inserted into the first pole receiver.

9. The apparatus of claim 8 wherein the table device includes a second pole receiver.

10. The apparatus of claim 9 wherein the second pole receiver includes a latching mechanism for holding a pole.

11. A method for assembling an adjustable height anchoring apparatus comprising the steps of: providing a drilling device having a point at a first end of the drilling device, wherein the drilling device comprises a drill bar and a first modified auger device disposed on said drill bar, wherein said modified auger device comprises a helical member comprising a leading edge, a terminal edge, and a common surface extending between the leading edge and the terminal edge that is continuous along the length of the helical member over at least a portion of the radius of the helical member, wherein a downwardly oriented flap is formed in said helical member as a partial discontinuity in the surface of the helical member between the leading edge and the terminal edge, such that the flap defines a supplemental leading edge disposed on said flap and a supplemental trailing edge disposed on at least a portion of the radius of the helical member, wherein said supplemental leading edge and said supplemental trailing edge are located on the same side of said drill bar, said supplemental leading edge is proximal to and substantially aligned with said supplemental trailing edge in the direction of the longitudinal axis of the drill bar, and there is substantially no offset between said supplemental leading edge and said supplemental trailing edge in the direction of the transverse axis of the drill bar; attaching a second end of the drilling device to a first end of a tube; attaching a latching device to a second end of the tube; slideably inserting a first end of an insertion bar into the second end of the tube so that the insertion bar lies at least partially in the tube and a substantial portion of the length of the insertion bar is slideable within said tube and the amount of the insertion bar that is inserted within the tube is selectably adjustable; and wherein the insertion bar can be slideably inserted within said tube over a substantial portion of the length of the insertion bar and the latching device can set a location of the insertion bar with respect to the tube so that a height is set, wherein the height is measured from a second end of the insertion bar to the point at the first end of the drilling device.

12. The method of claim 11 further comprising connecting a first pole receiver at the second end of the insertion bar; and wherein the first pole receiver can receive and retain a pole.

13. The method of claim 12 wherein the first pole receiver includes a latching mechanism for retaining a pole.

14. The method of claim 13 further comprising Forming a plurality of holes in the insertion bar dispersed along a length of the insertion bar; and wherein the latching device includes a portion which can be inserted into any one of the plurality of holes in order to set the location of the insertion bar with respect to the tube so that the height is set.

15. The method of claim 11 wherein the drilling device comprises a second modified auger device disposed on said drill bar, wherein said second modified auger device comprises a second helical member comprising a second leading edge, a second terminal edge, and a common surface extending between the second leading edge and the second terminal edge that is continuous along the length of the second helical member over at least a portion of the radius of the second helical member, wherein a second downwardly oriented flap is formed in said second helical member as a partial discontinuity in the surface of the second helical member between the second leading edge and the second terminal edge, such that the second flap defines a second supplemental leading edge disposed on said second flap and a second supplemental trailing edge disposed on at least a portion of the radius of the second helical member, wherein said second supplemental leading edge and said second supplemental trailing edge are located on the same side of said drill bar, said second supplemental leading edge is proximal to and substantially aligned with said second supplemental trailing edge in the direction of the longitudinal axis of the drill bar, and there is substantially no offset between said second supplemental leading edge and said second supplemental trailing edge in the direction of the transverse axis of the drill bar.

16. The method of claim 15 wherein the second modified auger device is closer to the point of the drilling device than the first modified auger device, and the second modified auger device is smaller in diameter than the first modified auger device.

17. The method of claim 11 further comprising providing a handle; and wherein the insertion bar includes a first opening, and wherein the handle can be inserted into the first opening and attached to the insertion bar; and wherein the handle can be used to rotate the drilling device about an axis passing through the tube, in order to drill the drilling device into the ground.

18. The method of claim 17 wherein the handle includes a first portion which has outer threads and a second portion which has inner threads; and wherein the first portion of the handle is inserted through the first opening in the insertion bar and into the second portion of the handle in order to attach the handle to the insertion bar.

19. The method of claim 12 further comprising providing a device for holding multiple poles; and wherein the device for holding multiple poles can be inserted into the first pole receiver.

20. The method of claim 12 further comprising providing a table device, and wherein the table device can be inserted into the first pole receiver.

21. The method of claim 20 wherein the table device includes a second pole receiver.

22. The method of claim 20 wherein the second pole receiver includes a latching mechanism for holding a pole.

* * * * *